US008796939B1

(12) United States Patent
Naumann

(10) Patent No.: US 8,796,939 B1
(45) Date of Patent: Aug. 5, 2014

(54) ACCELEROMETER-BASED ILLUMINATION SYSTEM FOR MOBILE DISPENSING DEVICES

(71) Applicant: Curtis William Naumann, Minneapolis, MN (US)

(72) Inventor: Curtis William Naumann, Minneapolis, MN (US)

(73) Assignee: Curtis William Naumann, Minneapolis, MN (US)

( * ) Notice: Subject to any disclaimer, the term of this patent is extended or adjusted under 35 U.S.C. 154(b) by 0 days.

(21) Appl. No.: 14/253,728

(22) Filed: Apr. 15, 2014

(51) Int. Cl.
*H05B 37/00* (2006.01)
*H05B 37/02* (2006.01)

(52) U.S. Cl.
CPC ..... *H05B 37/02* (2013.01)
USPC ..... 315/200 A; 315/297; 315/291

(58) Field of Classification Search
None
See application file for complete search history.

(56) References Cited

U.S. PATENT DOCUMENTS

| | | | | |
|---|---|---|---|---|
| 7,616,097 | B1 * | 11/2009 | Whang | 340/321 |
| 8,355,003 | B2 * | 1/2013 | Pope | 345/170 |
| 8,629,623 | B2 * | 1/2014 | Mountain | 315/200 A |
| 2004/0240198 | A1 * | 12/2004 | Van Laar et al. | 362/105 |
| 2008/0224988 | A1 * | 9/2008 | Whang | 345/102 |
| 2009/0312101 | A1 * | 12/2009 | Pope | 463/36 |
| 2012/0274218 | A1 * | 11/2012 | Mountain | 315/152 |

* cited by examiner

*Primary Examiner* — Crystal L Hammond

(57) ABSTRACT

An illumination system for mobile dispensing devices is disclosed. An acceleration sensor detects the acceleration of the device and a microcontroller analyzes the acceleration to determine if motion and tilt are present. If motion is greater than a threshold value, then side lights turn on at maximum brightness. Once motion is equal to or less than the threshold level, the side lights will progressively dim over a configurable period until being turned off. If the tilt angle of the device is greater than a configurable value from its vertical position, the top lights turn on at maximum brightness. Once the tilt is below or equal to its configurable value, the top lights will progressively dim over a configurable period until being turned off. If either the motion or tilt angle become greater than the programmable value during the dimming process, the corresponding light will again be illuminated at maximum brightness.

1 Claim, 3 Drawing Sheets

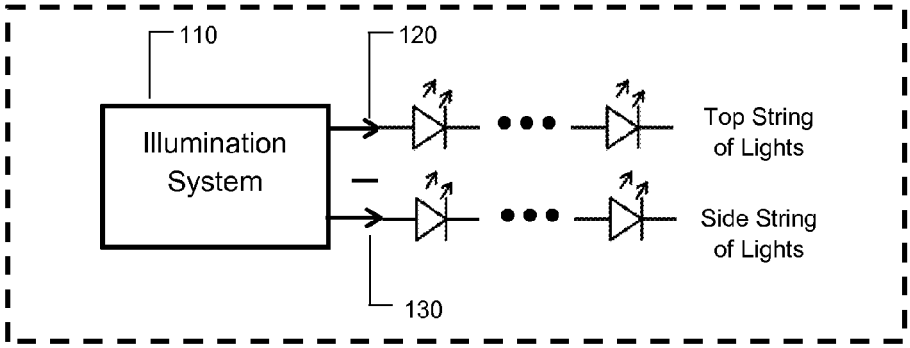
FIG. 1 Mobile Dispensing Device
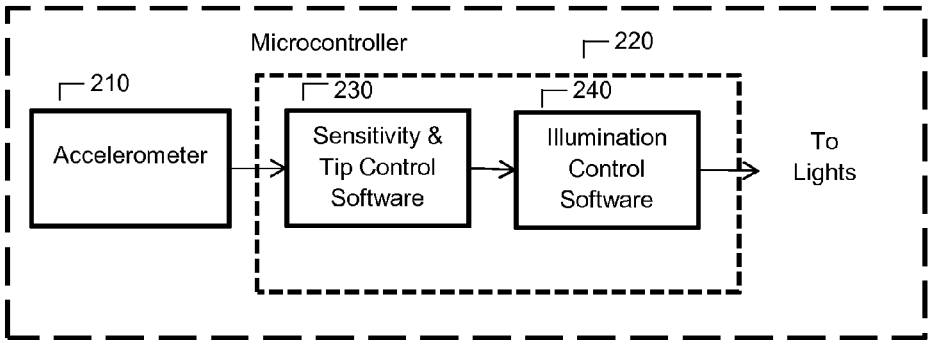
FIG. 2 Illumination System

ACCELEROMETER-BASED ILLUMINATION SYSTEM FOR MOBILE DISPENSING DEVICES

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURE BY THE INVENTOR OR A JOINT INVENTOR

Not Applicable

BACKGROUND OF THE INVENTION

The Accelerometer-based Illumination System for Mobile Dispensing Devices pertains to illumination on or around dispensed materials.

Restaurants and bars frequently dim the lights to set the mood and the atmosphere for a relaxing dining experience. The dim lighting makes it difficult to determine the amount and location of condiment dispensed, read text on both the menu and check, and find objects dropped from the table. While restaurants and bars may select a mobile dispensing device's construction material, dispensing method, its shape, its size, and its color to enhance the ambiance of the business establishment, an illumination system adds a further option.

Basic illumination systems such as a lit candle or a smart phone's flashlight are commonly used by restaurant and bar patrons to better see and locate items on and around the table. However, these methods suffer from drawbacks. Lit candles can be a fire hazard and the use of a smart phone may accidentally be pointed into a patron's eye making the dining experience uncomfortable. Adding an illuminative system to a mobile dispensing device provides both a functional and aesthetic component.

It is therefore desirable to develop an illumination system for mobile dispensing devices. It is further desirable to develop an illumination system that is not a fire hazard, will not be intrusive to other patrons and which enhances the dining experience through illuminative methods.

BRIEF SUMMARY OF THE INVENTION

This invention relates generally to mobile dispensing devices. More specifically, this invention relates to illumination systems for mobile dispensing devices.

BRIEF DESCRIPTION OF THE SEVERAL VIEWS OF THE DRAWING

For a better understanding of the invention, reference should be made to the following detailed descriptions taken in conjunction with the accompanying drawings in which:

FIG. 1 illustrates a block diagram of a mobile dispensing device constructed in accordance with an embodiment of the invention.

FIG. 2 illustrates a block diagram of an illumination system consisting of an accelerometer and a microcontroller in accordance with an embodiment of the invention.

DETAILED DESCRIPTION OF THE INVENTION

Figure 3:
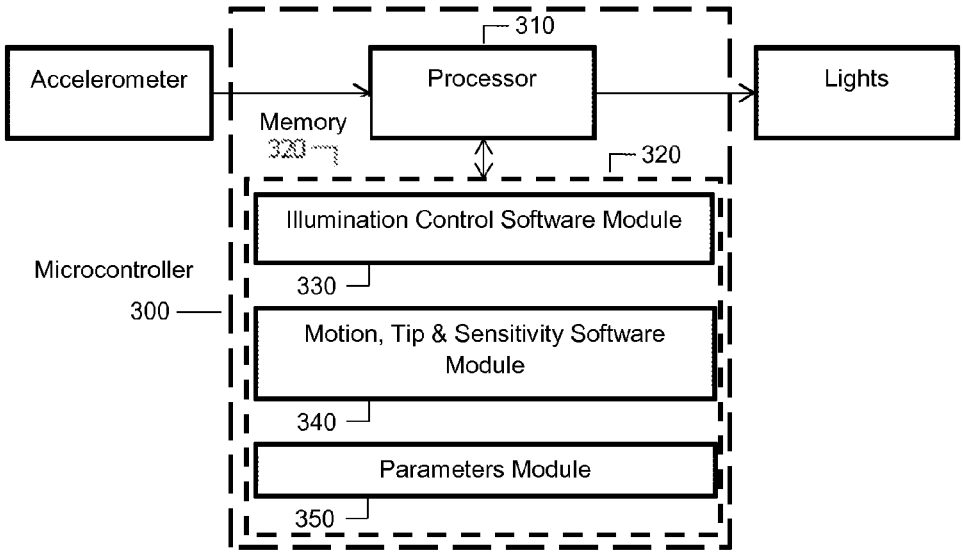
FIG. 3 illustrates an exemplary microcontroller for detecting motion and tip and illuminating top and side lights dependent on the level of motion and tip.

In one embodiment of the invention, an accelerometer is placed within a mobile dispensing device to detect acceleration. Any acceleration detected could indicate movement of the device, i.e. is being picked up. Large scale movement of the device results in an acceleration signal having characteristics different than other events such as bumping the table top, placing items onto the table top, etc. The detected acceleration is analyzed to determine whether it corresponds to such large-scale movement of the device, rather than an innocuous event that occurs nearby. If so, side lights are illuminated to show the sides of the device for ease in retrieval by providing easier focus of the device's orientation and shape. The side lights also add ambiance to the surrounding area. If continued movement of the device includes it being tipped beyond a configurable angle, then top lights are illuminated to allow for easier identification of the amount and delivery location of the dispenser's contents. The top lights can also be used to provide supplemental lighting to read text, i.e. menus, checks, etc. and to provide primary lighting in emergency situations where there is power loss. Further embodiments of the invention include the ability to tune various parameters through programming of the microcontroller within the illumination system.

In such a manner, illumination is accomplished via a relatively small and lightweight accelerometer that can be incorporated into the mobile dispensing device itself without the need for candles or smart phone flashlight.

FIG. 1 illustrates a block diagram of a mobile dispensing device constructed in accordance with an embodiment of the invention. A mobile dispensing device 100 is controlled by an illumination system 200. The illumination system 200 contains both an accelerometer which detects device movement and tipping angle and a microcontroller that processes input from the accelerometer and send signals on, off and dimming commands to the top string of lights 120 and the side string of lights 130.

In operation, the illumination system 200 detects acceleration undergone by the mobile dispensing device 100, such as when the mobile dispensing is picked up. Upon examining the characteristics of the acceleration and determining that the device has been picked up, the illumination system 200 transmits a signal to the side string of lights 130 to power on at maximum brightness. In this manner, the mobile dispenser device 100 illuminates the sides of the device for ease in determining orientation and physical characteristics of the mobile dispensing device 100 and adding ambiance to the area. Furthermore, once the illumination system 200 no longer detects movement such as when the mobile dispensing device 100 is placed back down, the side string of lights 130 will progressively dim over a configured period until the side string of lights 130 is turned off. If movement is detected in the mobile dispensing device 100 during the dimming period, the illumination system 200 will transmit a signal to the side string of lights 130 to again illuminate at maximum brightness.

Additionally, the illumination system 200 detects the tipping angle of the mobile dispensing device 100. If the tipping angle becomes greater than a configurable tipping point parameter, the illumination system will transmit a signal to the top string of lights 120 to power on at maximum brightness. In this manner, the mobile dispenser device 100 can be used as a spotlight to illuminate the dispensing area for quantity and location of device contents delivered. The top string of lights 120 can also be used to provide additional lighting to read menus, read checks and as a flashlight during a power outage. Furthermore, once the tipping angle becomes less than or equal to the tipping point parameter, such as when the mobile dispensing device 100 is returned to its upright position, the top string of lights 120 will progressively dim over a configured period until the top string of lights 120 is turned off. If the tipping angle becomes greater than the configured tipping point angle while the mobile dispensing device 100 is dimming then the top string of lights 120 the illumination system 200 will transmit a single to the top string of lights 120 to again illuminate at maximum brightness.

In order to more accurately detect deliberate movement of the mobile dispensing device 100, and avoid illuminating the mobile dispensing device 100 when extraneous movement is detected such as placing something on the table surface or bumping the table, software programmed within the illumination system 200 will not illuminate the side string of lights 130 until movement exceeds a configurable threshold parameter.

FIG. 2 illustrates a block diagram of the illumination system 200 constructed in accordance with an embodiment of the invention. The illumination system 200 includes an accelerometer 210 for detecting acceleration and a microcontroller 300. In this embodiment, the microcontroller 300 includes a motion, tilt and sensitivity software module 230 and illumination control software module 240.

The motion, tilt and sensitivity software module 230 contains parameters for: the minimum sensitivity parameter required to actuate the side string of lights 130, the tipping point parameter to turn on or off the top string of lights 120, motion and tipping wait time parameters for the time to wait once the accelerometer 210 sends input to the microcontroller 300 such that a) the tipping angle is less than or equal to the tipping point parameter thus starting the dimming process of the top string of lights 130 and b) accelerometer 210 detects motion less than or equal to the minimum sensitivity parameter thus starting the dimming process of the side string of lights 130.

The illumination system 200 is typically built on one a single circuit board with the accelerometer 210 mounted on the board and electronically connected to the microcontroller 300. The invention includes alternative embodiments, however. For instance, the accelerometer 210 can be mounted on or in the housing of the mobile dispensing device 100 and remote from the microcontroller 300.

The accelerometer 210 is coupled to the housing of the mobile dispensing device 100, where acceleration on the mobile dispensing device 100 is detected. The accelerometer 210 converts this acceleration to an electronic acceleration signal and supplies this signal to the microcontroller 300. It is common for the accelerometer 210 to pick up acceleration frequencies both deliberate and extraneous in nature. Extraneous accelerations can include the vibration caused by placing an object on the table or bumping the table on which the mobile dispensing device 100 is placed. As a result, the invention includes a system for isolating those frequencies that are deliberate i.e. identifying continual motion. In this manner, momentary blinking of the side string of lights 130 is avoided.

FIG. 3 illustrates an exemplary microcontroller 300 for detecting various types of motion of the mobile dispensing device 100 using software configuration parameters within the embodiment of the invention. Here the microcontroller 300 includes a processor 310 in electronic communications with a memory 320 that stores modules containing instructions for carrying out various processes. In this embodiment, the modules include an illumination control software module 330 for sending lighting commands and motion, tilt and sensitivity software module 340 for determining motion, tip and deliberate movement. Both the illumination control software module 330 and the motion, tip and sensitivity software module 340 make use of the parameters module 350 for comparison of the acceleration signal. Such a configuration allows the processor 310 to monitor and receive an acceleration signal from the accelerometer 210 to determine how and when the lights should be illuminated. As discussed, a comparison metric can be calculated to determine the degree to which a detected acceleration matches the parameters module 350. If such a comparison indicates that the light state necessitate a change, the processor 310 then sends a signal out to the top string of lights 120 and/or the side string of lights 130 to affect that change.

The memory 320 can be a read-only memory or it can be a re-writable memory. The latter configuration offers advantages in terms of flexibility. For instance, a re-writable memory 320 allows the various modules to be updated so that movement, sensitivity and lighting options can be modified later. This allows the microcontroller 300 to be upgraded over time, so as to provide enhanced usage of both the top string of lights 120 and the side string of lights 130.

Figure 4:
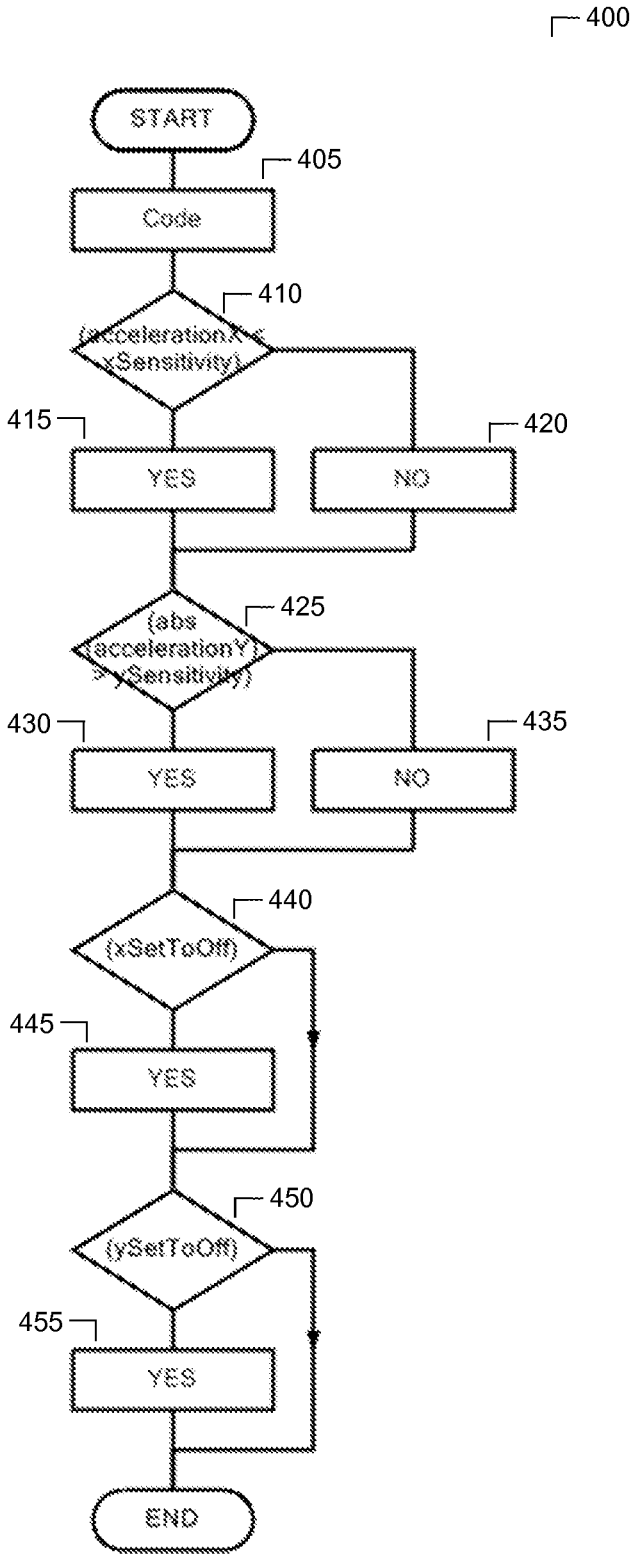
FIG. 4 illustrates a flow diagram of an illumination process in accordance to an embodiment of the invention.

FIG. 4 illustrates a flow diagram of an illumination process 400 according to the embodiment of the invention. The illumination process 400 is performed by a mobile dispensing device such as the mobile sensing device 100 illustrated in FIG. 1.

The illumination process starts with an initialization of parameters in the process block code 405. The following are initialized: 1) The accelerometer output for both motion and tipping, 2) Corresponding inputs to the microcontroller, 3) Microcontroller output to the lights, 4) Illumination thresholds, 5) Counters for determining when to start the dimming of the lights, 6) Flags used to determine the current status of the lights (on, dimming, off). Once initialization is complete the process block code 405 begins an infinite looping process whereby pulses from the accelerometer are received by the microcontroller and converted to accelerations.

The acceleration is used to detect motion and is tested against the motion sensitivity parameter in the decision branch (acceleration X<xSensitivity) 410. If the acceleration exceeds the motion sensitivity parameter then the side lights are to be lit at the maximum brightness and the flow continues to the process block yes 415. The process block yes 415 determines if the 'side lights on' flag is set, meaning the lights are already turned on. If the 'side lights on' flag is set then no further action is required and process continues to decision branch ((abs)accelerationY>ySensitivity) 425. If the 'side lights on' flag is not set, a signal is sent from the microprocessor to the side lights to turn on at maximum brightness. The 'side lights on' flag is set to true and a 'no motion' counter is reset. If the decision branch (accelerationX<xSensitivity). 410 determines that the acceleration does not exceed the motion sensitivity parameter then flow continues to process block no 420. In this case, no motion is detected and the 'no motion' counter is increased and tested against a 'delay' parameter for turning off side the lights. If the 'no motion' counter exceeds the 'side lights delay time' parameter, then the 'turn side lights off' flag is set.

Similar to testing for motion, the acceleration used to detect tip angle is tested against the tipping sensitivity parameter in decision branch ((abs)accelerationY>ySensitivity) 425. If the acceleration exceeds the tipping sensitivity parameter then the top lights are to be lit and flow continues to process block yes 430. Process block yes 430 tests a 'top lights on' flag to determine if the top lights are already lit. If they are already lit, no further action is necessary and process continues to decision branch XsetToOff 410. If the 'top lights on' flag is not set, a signal is sent from the microprocessor to the top string of lights to turn on at maximum brightness. The 'top lights on' flag is set to true and a 'no tipping' counter is reset. If the decision branch ((abs) accelerationY>ySensitivity) 425 determines that the acceleration does not exceed the tipping sensitivity parameter then flow continues to process block no 435. In this case, the tipping did not exceed the programmed tipping sensitivity parameter, so the 'no tipping' counter is increased and tested against the 'top lights delay time' parameter for turning off the top lights. If the 'no tipping' counter exceeds the 'top lights delay time' parameter, then the 'turn top lights off' flag is set and process continues with decision branch (xSetToOff) 440.

The decision branch (xSetToOff) 440 tests if the top string of lights is to be turned off based upon the setting of the 'turn top lights off' flag. If the flag is not set then the flow continues with decision branch (ySetToOff) 450: Otherwise the flow continues to process block yes 445. A loop is initiated to start the dimming and turn off process of the top string of lights. The body of the loop checks to see if the dimming condition should be terminated because the tipping angle exceeds the tipping sensitivity parameter. Process block yes 445 interrogates input from the accelerometer, converts the input to an acceleration and tests whether the tipping angle exceeds the tipping sensitivity parameter. If the acceleration does exceed the tipping sensitivity, the microcontroller sends a signal to the top string of lights to illuminate at the maximum brightness. The 'top lights on' flag, the 'turn top lights off' flag, the 'no tipping' counter are reset, and the dimming process is terminated. If the acceleration continues to be less than the tipping angle parameter the top string of lights will continue dimming until it is turned off, after which a flag is cleared for the 'top lights on' and flow continues to decision branch (ySetToOff) 450.

The decision branch (ySetToOff) 450 tests if the side string of lights is to be turned off based upon the setting of the 'turn side lights off' flag. If the flag is not set then the flow continues at the start of the flow, process block code 405. Otherwise, the flow continues to process block yes 455. A loop is initiated to start the dimming and turn off process of the side string of lights. The body of the loop checks to see if the dimming condition should be terminated because the acceleration exceeds the motion sensitivity parameter. Process block yes 455 interrogates input from the accelerometer, converts the input to an acceleration and tests whether the acceleration exceeds the motion sensitivity parameter. If the acceleration does exceed the motion sensitivity parameter, the microcontroller sends a signal to the side string of lights to illuminate at the maximum brightness. The 'side lights on' flag, the 'turn side lights off' flag, the 'no motion counter' are reset, and the dimming process is terminated. If the acceleration continues to be less than the motion sensitivity parameter then the side string of lights will continue to dim until turned off, after which a flag is cleared for the side string of lights and flow continues to decision branch (ySetToOff) 450. Flow then continues at the start of the flow, process block code 405.

The foregoing description, for purposes of explanation, used specific nomenclature to provide a thorough understanding of the invention. However, it will be apparent to one skilled in the art that the specific details are not required in order to practice the invention. In other instances, well-known circuits and devices are shown in block diagram form in order to avoid unnecessary distraction from the underlying invention. Thus, the foregoing descriptions of specific embodiments of the present invention are presented for purposes of illustration and description. They are not intended to be exhaustive or to limit the invention to the precise forms disclosed, obviously many modifications and variations are possible in view of the above teachings. For example, the microcontroller 220 or the processor 310 can be configured to filter or modify acceleration signals and evaluate or compare them to any programmable parameter, as appropriate in order to reliably detect movement or tipping. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A method for providing illumination for a mobile dispensing device by an illumination system, comprising: detecting an acceleration of the mobile dispensing device; generating an acceleration signal in response to detecting motion and tipping angle of the mobile dispensing device; processing the acceleration signals by analyzing the metrics indicative of a degree to which the acceleration signal matches a known motion or tipping condition; generating an illumination signal only when the analysis of the metric indicates that the degree to which the acceleration signal exceeds the known illumination condition which is greater than a pre-determined threshold value; sending a maximum brightness illumination signal to the processor in order for the processor to initiate the lighting of the appropriate set of lights based upon the illumination signal; generating a fade and lights-off signal when the analysis of the metric indicates that the degree to which the acceleration signal falls below the known fade and lights-off condition which is less than a pre-determined threshold value; and sending the fade and lights-off signal to the processor in order for the processor to initiate the fade and lights-off for the appropriate set of lights based upon the illumination signal; generating an illumination signal during the fade and lights off process only when the analysis of the metric indicates that the degree to which the acceleration signal exceeds the known illumination condition which is greater than a pre-determined threshold value; sending a maximum brightness illumination signal to the processor in order for the processor to initiate the lighting of the appropriate set of lights based upon the illumination signal.

* * * * *